US008007320B1

(12) United States Patent
Zhang et al.

(10) Patent No.: US 8,007,320 B1
(45) Date of Patent: Aug. 30, 2011

(54) COMPLEX ELECTRICAL CONNECTOR

(75) Inventors: George Huanyi Zhang, Irvine, CA (US); Bin Pan, Irvine, CA (US)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 21 days.

(21) Appl. No.: 12/701,610

(22) Filed: Feb. 8, 2010

(51) Int. Cl.
*H01R 25/00* (2006.01)

(52) U.S. Cl. ..... 439/638

(58) Field of Classification Search ..... 439/638, 439/607.01, 639, 680, 682, 692, 470, 79, 439/660, 540.1
See application file for complete search history.

(56) References Cited

U.S. PATENT DOCUMENTS 6,050,831 A * 4/2000 Wu et al. ..... 439/76.1
6,939,177 B2 9/2005 Kato et al.
7,331,824 B2 * 2/2008 Lin ..... 439/638
7,614,920 B1 * 11/2009 Yi ..... 439/682

* cited by examiner

*Primary Examiner* — Edwin A. Leon
(74) *Attorney, Agent, or Firm* — Wei Te Chung; Andrew C. Cheng; Ming Chieh Chang

(57) ABSTRACT

An electrical connector includes a first connector interface and a second connector interface arranged side by side and spaced from each other along a longitudinal direction of the electrical connector. The first connector interface is of tongue portion with a plurality of contacts arranged on the tongue portion; the second connector interface is of frame shape. Two end walls are disposed at two opposite ends of the connector along the longitudinal direction and aligned with two connector interfaces and a connecting wall connects with the end walls at one side of the connector interfaces. The second connector interface has at least one mating cavity, which has no wall at one side so that the mating cavity directly faces to one guiding slot on the end wall.

17 Claims, 5 Drawing Sheets

COMPLEX ELECTRICAL CONNECTOR

BACKGROUND OF THE INVENTION

1. Field of the Invention

The present invention relates to an electrical connector having a plurality of connector interfaces arranged side by side, and particularly to a USB interface and a power interface.

2. Description of Related Arts

Recently, personal computers (PC) are used of a variety of techniques for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

With the requirement of data transmission speed is higher and higher, the speed of a USB 2.0 plug is insufficient to support high-speed transmission between external devices. Therefore the USB specification is developed at a higher version of USB 3.0. A standard USB 3.0 accelerating data transmission to 4.8 Gbps, is designed to be backwards-compatible with USB 2.0.

The USB 3.0 Connectors and Cable Assemblies have three types, A type, B type and Micro B type receptacles, plugs and wire arrangement. Said three type connectors including plugs and receptacles, have different interface shapes, resulting in independent usage by themselves to some extent. USB 3.0 Micro B Type has two interface portions side by side and partitioned from each other by a partition wall integrated with the shell. USB 3.0 Micro B Type as now known will commonly be used in consumer. SO we hope to desire a USB 3.0 Micro B Type carrying other port which can be used in other industries.

Hence, a new electrical connector is desired.

SUMMARY OF THE INVENTION

An electrical connector comprises a first connector interface and a second connector interface arranged side by side and spaced from each other along a longitudinal direction of the electrical connector, the first connector interface is of tongue portion with a plurality of contacts arranged on the tongue portion; the second connector interface is of frame shape, two end walls are disposed at two opposite ends of the connector along the longitudinal direction and aligned with said two connector interfaces, each end wall has a recessed guiding slot, a connecting wall connects with the end walls at one side of said two connector interfaces, the second connector interface comprises opposite first and second walls parallel to the tongue portion of the first connector interface and a third wall perpendicular connecting with the first and second walls commonly forming at least one mating cavity, the second connector interface has no wall at one side opposite to the third wall so as to the at least one mating cavity directly faces to one guiding slot.

Other advantages and novel features of the invention will become more apparent from the following detailed description of the present embodiment when taken in conjunction with the accompanying drawings.

DETAILED DESCRIPTION OF THE PREFERRED EMBODIMENT

Further detailed description of the preferred embodiments of this present invention is set forth below along with the attached drawings.

Figure 1:
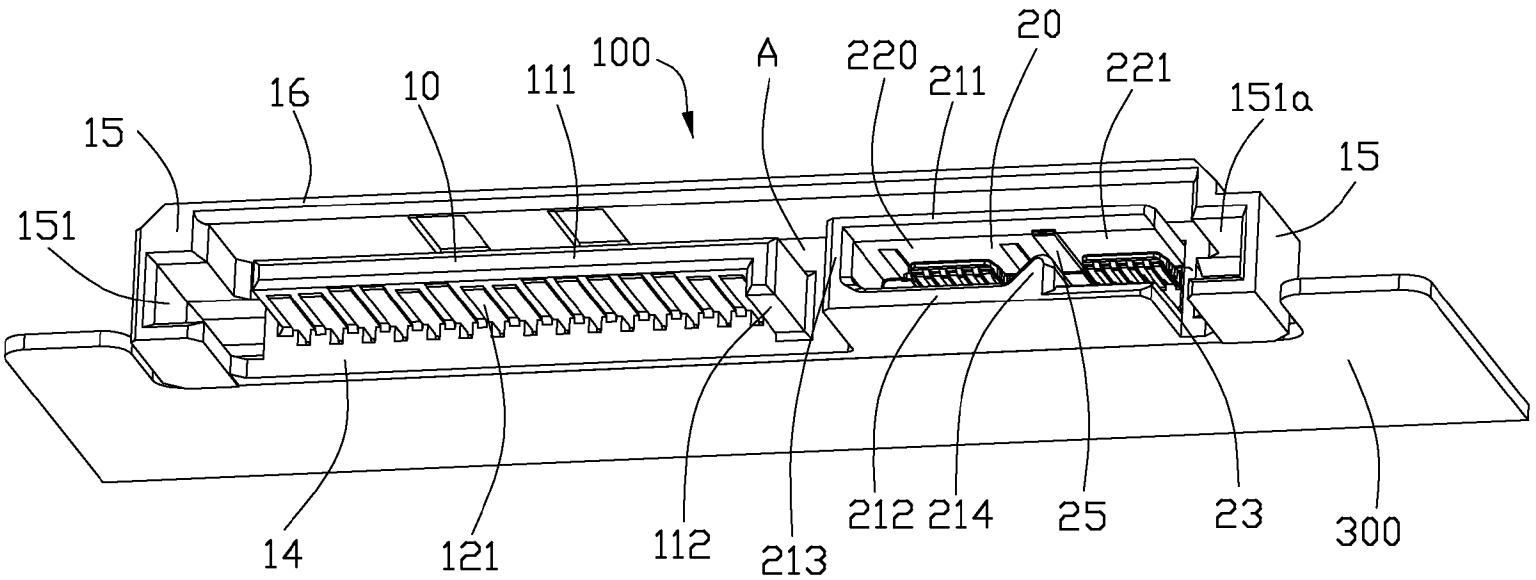
FIG. 1 is a perspective view of a first electrical connector mounted on a printed circuit board of an embodiment in accordance with the present invention.
Figure 3:
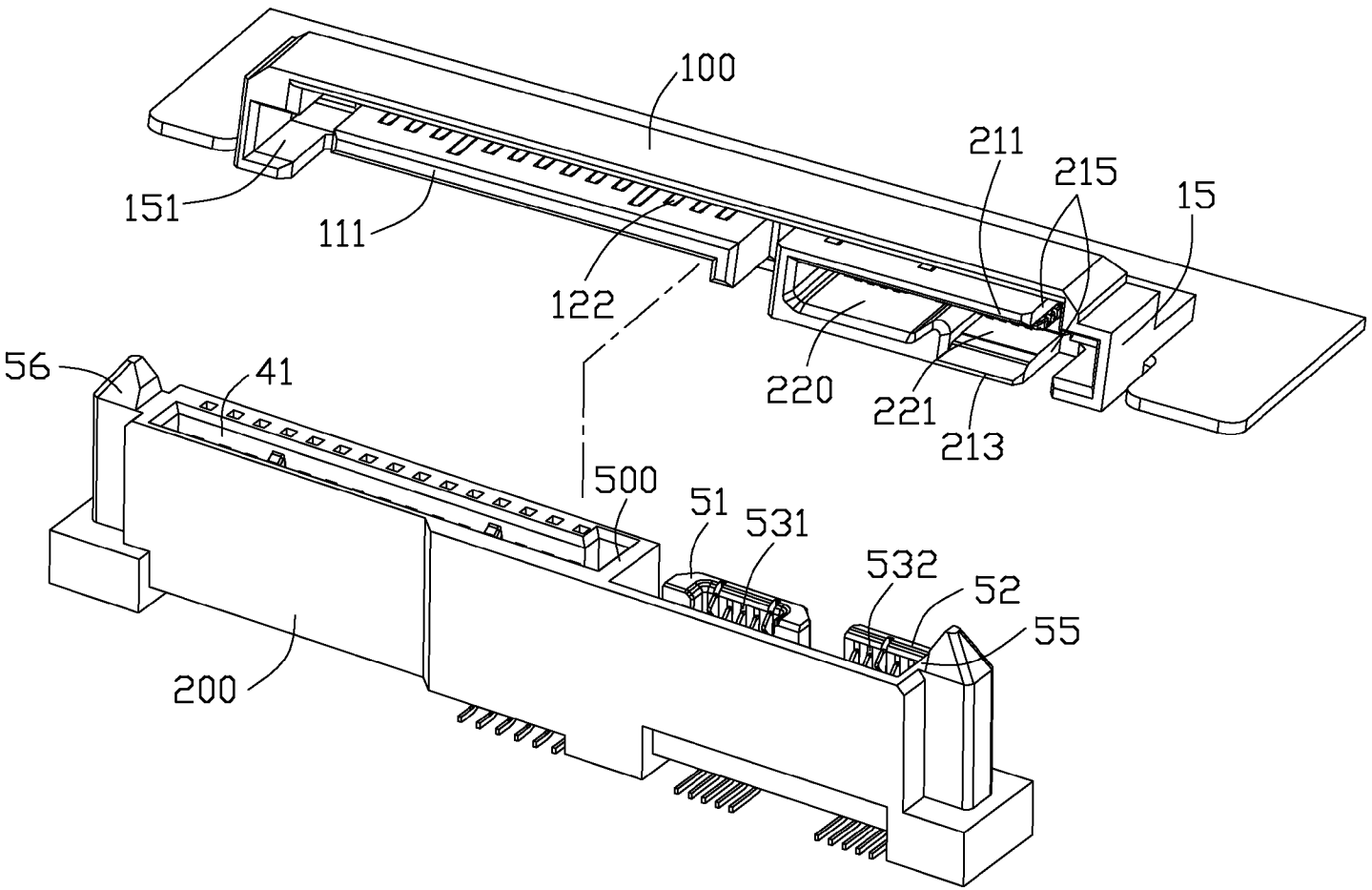
FIG. 3 is a perspective view of the first and second electrical connector.

Referring to FIGS. 1&3 showing a first electrical connector 100 which is adapted for setting in device equipment, mounted on a printed circuit board 300. The first connector 100 includes two connector interfaces 10, 20 which are defined to complete a functional electrical connection. The two connector interfaces are arranged side by side along a longitudinal direction of the connector and spaced from each other with a distance A. The first connector interface 10 is of a substantially tongue shape with a plurality of contacts 121, 122 which are arranged along the longitudinal direction of the connector on a lower surface and an upper surface of the tongue portion 111. The second connector interface 20 is of a rectangular frame shape. The connector interface 20 is surrounded by an upper wall 211, a lower wall 212 and a sidewall 213 commonly. The second connector interface 20 is divided into two port portions by a partition wall 214 integrated with the lower wall 212 to define two mating cavities 220, 221. Two tongue portions arranged with a plurality of contact 23 on a lower surface thereof, extend into said two mating cavities 220, 221 respectively. The partition wall 214 is spaced away from the upper wall 211 by almost half of the sidewall 213, so said two mating cavities communicates with each other through space of the partition wall 214 along the longitudinal direction of the connector. The second connector interface 20 is adapted for USB 3.0 Micro B type which is backward to a USB 2.0 Micro B type, i.e. the first mating cavity 220 can also be inserted with a USB 2.0 Micro B type plug connector and said two mating cavities can also be inserted with the USB 3.0 Micro B type at a time.

The tongue portion 111 further defines a short upright wall 112 at one end thereof adjacent to the second connector interface 20. The upright wall 12 is used as an anti-mating means. The tongue portions 111 of the first connector interface 10, and the frame portion and tongue portions 220, 221 of the second connector interface 20 are made from insulating material and extend from a base portion 14 made from insulting material by integration or insertion method. Please note said three wall 211, 212, 213 are made from insulating housing, not a metal sheet.

A pair of end walls 15 are disposed at two opposite ends of the base portion 14 and an upper connecting wall 16 connects with said two end walls 15 at one side of the connector interfaces 10, 20. The end wall 15 has a recessed slot 151 at the inside thereof to form a forward guiding slot 151. The guiding slots 151 are aligned with the tongue portions 111 and the frame portion in the longitudinal direction.

The frame portion of the second connector interface 20 has no sidewall at one side opposite to the sidewall 213 so the mating cavity 221 opens to the guiding slot 151*a* at one end of the end wall 15.

Figure 2:
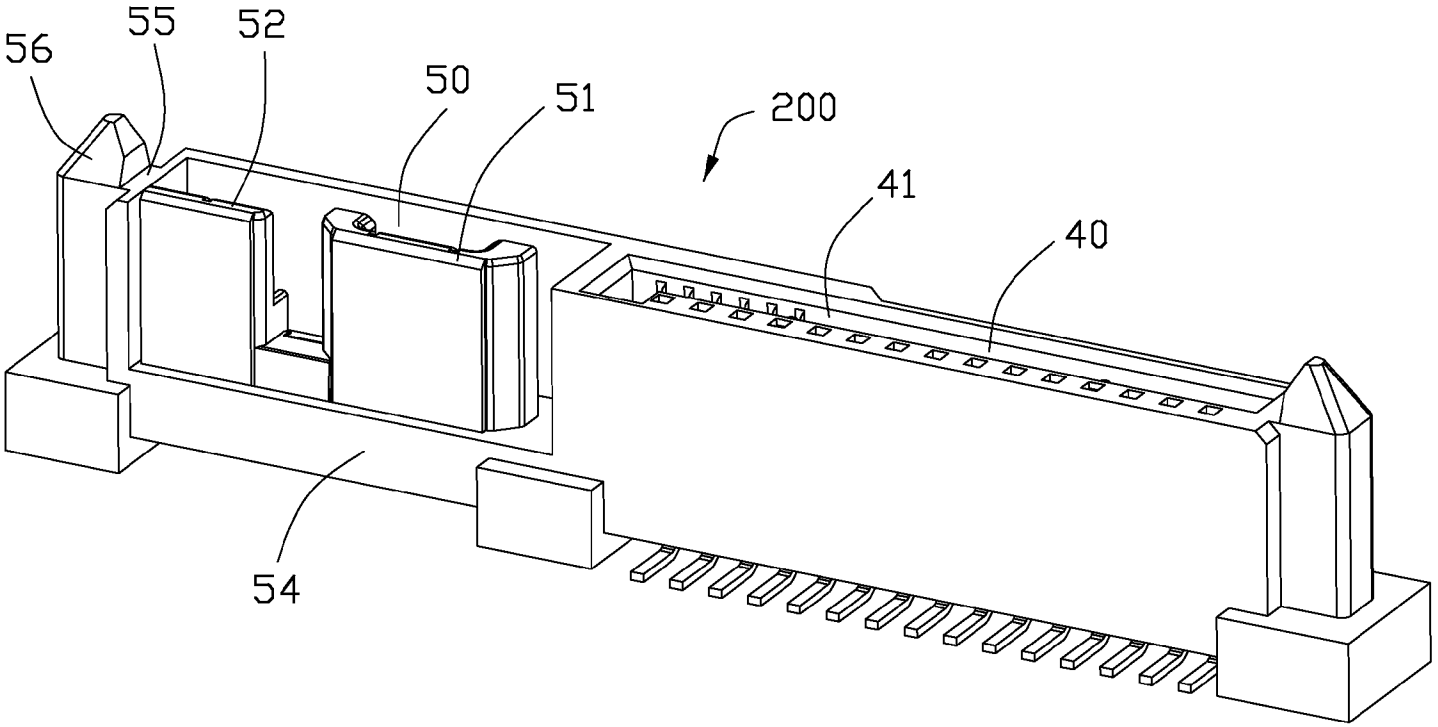
FIG. 2 is a perspective view of a second electrical connector adapted for mating with the first electrical connector.

Referring to FIGS. 2&3 showing a second electrical connector 200 of backplane connector type, which is adapted for mating with said first connector 100. The second connector 200 has a third connector interface 40 of a forward opening L shaped mating slot 41 surrounded by four sidewall and a forth connector interface 50 spaced from the third connector interface 40. The forth connector interface 50 is in a form of two tongue portions 51, 52 side by side with a plurality of contacts 531, 532 thereof, extending from a base portion 54. The first tongue portion 51 is of an inverted bracket. The second tongue portion 52 is of plate shape and jointed with one end wall 55. Two guiding posts 56 with tube front ends beyond front mating edges 500 of the third and forth connector interface 40, 50.

The second connector 200 is used to be inserted into the first connector. In application, the second and the forth interfaces 20, 50 complete a USB signal transmission and the first and third interfaces 10, 40 complete power transmission. As best shown in FIG. 3, the L shaped tongue portion 111 is inserted into the mating slot 41. The two mating cavities 220, 221 are inserted with the tongue portions 51, 52 of the second connector. The upper wall 211 and the lower wall 213 both space away from the inside of the end wall 15 with a distance and said two walls are aligned with each other in an upper-to-lower direction perpendicular to the longitudinal direction. The second tongue portion 52 of the second connector is inserted into the second mating cavity 221 and the end wall 55 (best shown in FIG. 2) is just sandwiched by the end wall 15 and two end edges 215 of the upper and lower wall 211, 213. The guiding slots 151 of the first connector 100 are inserted with the post 56 of the second connector. The joint of the second tongue portion 52 and the end wall 55 will increase rigidity of the second tongue portion 52.

Figure 4:
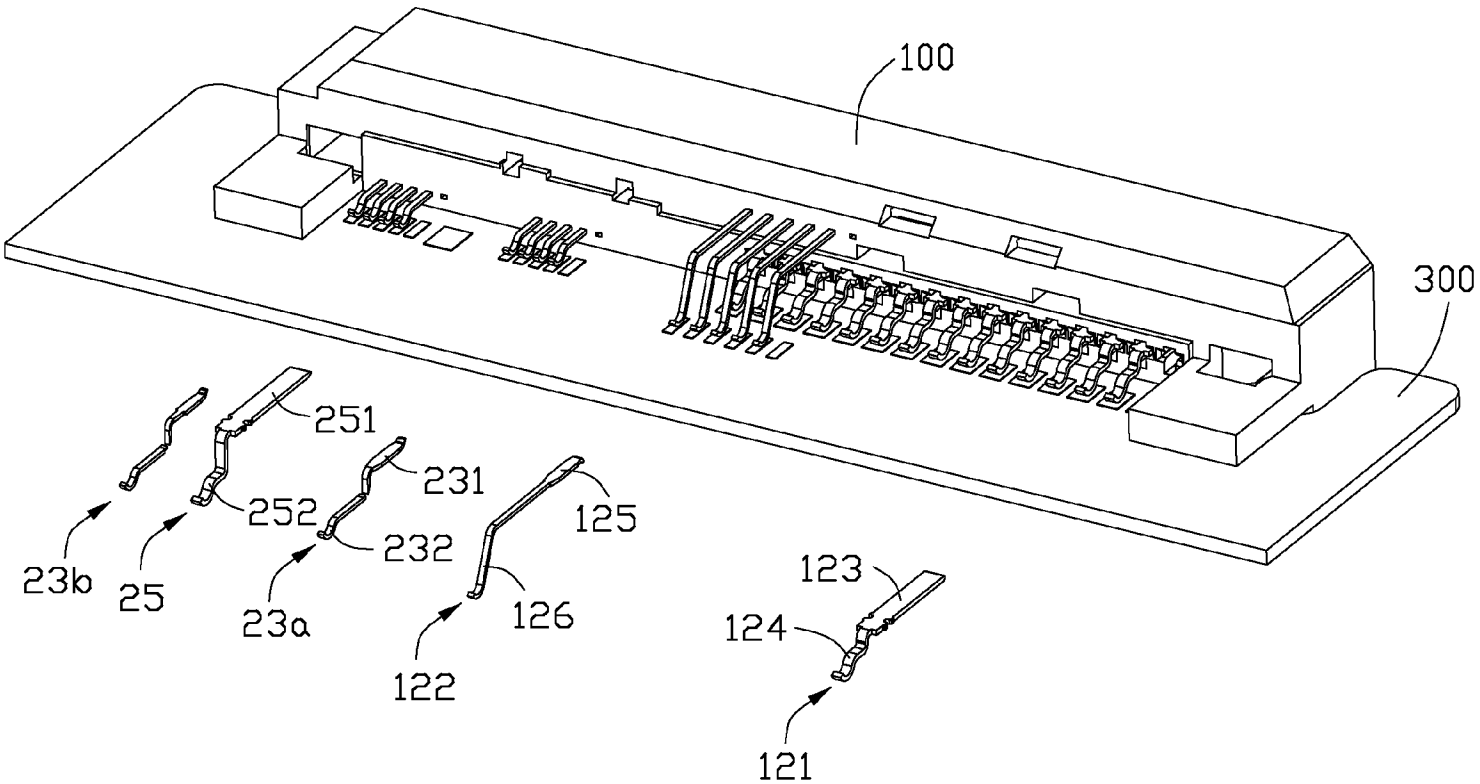
FIG. 4 is a perspective, exploded view of the first electrical connector.

A detailed configuration of the first and second connector 100, 200 will be given. Please referring to FIG. 4, the plurality of the contacts 121 on the lower face of tongue portion and the plurality of contact 122 on the lower face of the tongue portion of the first connector interface both have non-elastic plate contacting portions 123, 125 and leg portions 124, 126 elastically abutting on the PCB 300. The leg portions 124 are bend three times so as to increase the elastic performance of the leg portion. The plurality of contacts 23*a*, 23*b* arranged on the lower face of two tongue portions of the second connector interface 20 have non-elastic plate contacting portions 232 and abutting leg portions 232. A detecting pin 25 has a non-elastic plate contacting portions 251 and abutting leg portion 252. The detecting pin 25 is located on an inner face of the upper wall 211 as shown in FIG. 1 and just aligned with the partition wall 214.

Figure 5:
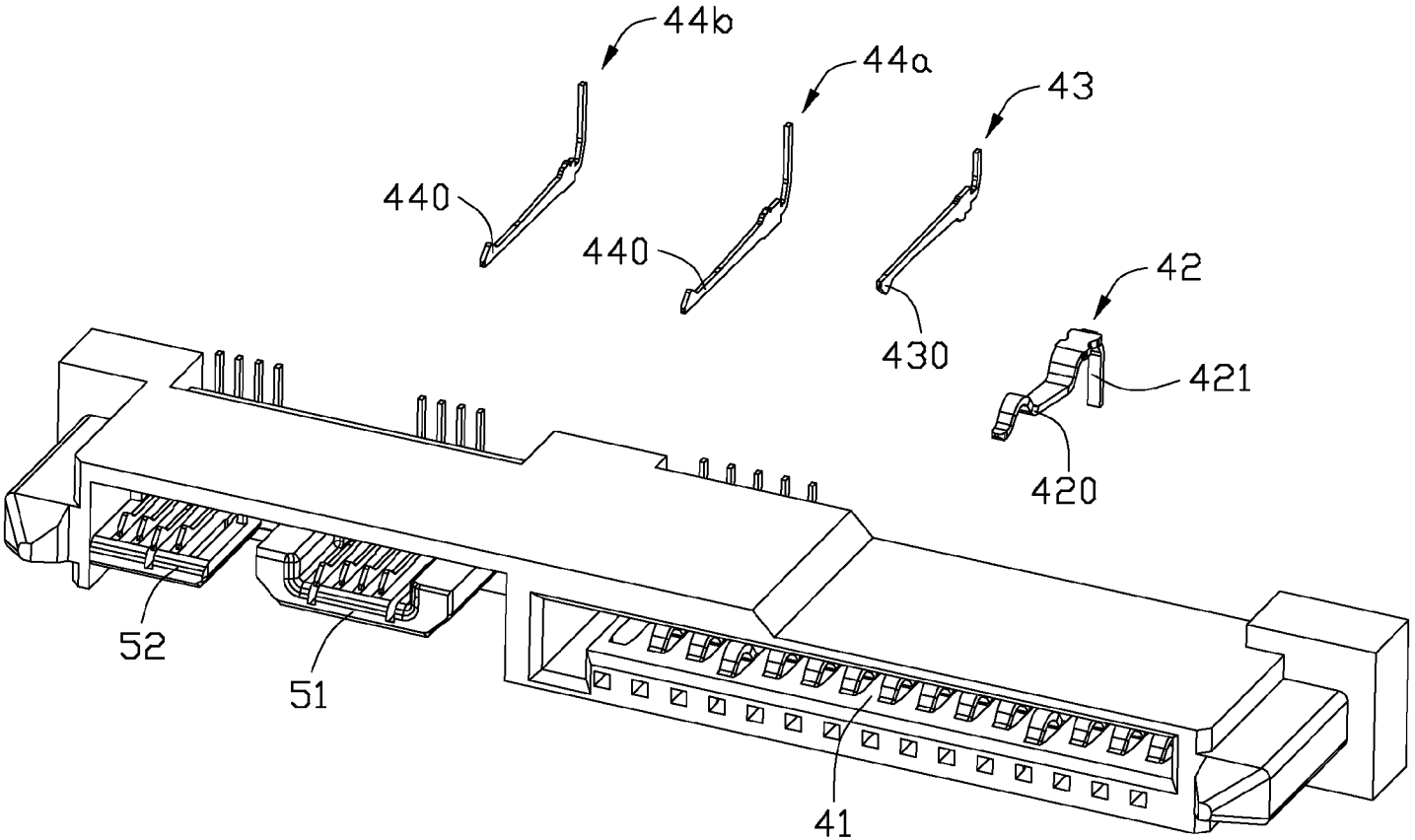
FIG. 5 is a perspective, exploded view of the second electrical connector.

Please referring to FIG. 5, a plurality of the contacts 42 have elastic contacting portions 420 arranged in the passageways in one inner facer of the mating slot 41 and leg portions 421 of through hole type perpendicular to the contacting portions. A plurality of contacts 43, 44, 45 of similar type have contacting portions 430 on another inner face of the mating slot and contacting portions 440 on the tongue portions 51, 52. The contacting portions 440 of the contacts 44*a*, 44*b* face in a same direction while opposite to the contacts 43.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

a first connector interface and a second connector interface arranged side by side and spaced from each other along a longitudinal direction of the electrical connector;

the first connector interface being of tongue portion with a plurality of contacts arranged on the tongue portion;

the second connector interface being of frame shape;

two end walls disposed at two opposite ends of the connector along the longitudinal direction and aligned with said two connector interfaces, each end wall having a recessed guiding slot;

a connecting wall connecting with the end walls at one side of said two connector interfaces;

wherein the second connector interface comprises opposite first and second walls parallel to the tongue portion of the first connector interface and a third wall perpendicularly connecting with the first and second walls to commonly form at least one mating cavity, and the second connector interface has no wall at one side opposite to the third wall so that the at least one mating cavity directly faces to one guiding slot.

2. The electrical connector as described in claim 1, wherein a partition wall projects into said at least one mating cavity from the second wall to divide said at least one mating cavity into two mating cavities.

3. The electrical connector as described in claim 2, wherein two tongue portions extend in the two mating cavities respectively.

4. The electrical connector as described in claim 3, wherein end edges of the first and the second walls and one tongue portion in the mating cavity nearer to the end wall are aligned with each other in a direction perpendicular to the first wall.

5. The electrical connector as described in claim 4, wherein said end edges space away from an inside of the end wall.

6. The electrical connector as described in claim 4, wherein said first, second and third walls integrally extend from a base portion of insulating material.

7. An electrical connector assembly comprising:

a first connector comprising a first connector interface and a second connector interface, the first connector interface being in a tongue shape and the second connector interface being in a frame shape;

a second connector mating with the first connector, the second connector comprising a third connector interface and a fourth connector interface which are arranged side by side along a longitudinal direction thereof and mating with the first and second interfaces respectively;

the third connector interface defining a mating slot surrounded by sidewalls, the fourth connector interface defining two tongue portions with a plurality of contacts arranged on the tongue portions;

wherein the tongue portions of the fourth connector interface are arranged side by side and spaced away from each other along the longitudinal direction, one tongue portion joined with an inner face of one end wall, of which at an outer face a guiding post is defined.

8. The electrical connector assembly as described in claim 7, wherein a connecting wall connecting with one wall of the third connector interface and said one end wall at one side of the tongue portions, the connecting wall being parallel to the tongue portion and face to the plurality of contacts directly.

9. The electrical connector assembly as described in claim 8, wherein the mating slot has a plurality of contacts on opposite inner faces thereof.

10. The electrical connector assembly as described in claim 9, wherein mating faces of the third and fourth connector interface are in a same plane.

11. An electrical connector assembly comprising:

a first connector including:

a first insulative housing defining a longitudinal direction, a transverse direction and a mating direction perpendicular to one another;

said first housing defining a forwardly extending first mating tongue essentially in compliance with a first mating interface, and a pair of forwardly extending second mating tongues essentially in compliance with a second mating interface, said first mating tongue and said pair of second mating tongues being side by side arranged with each other in said longitudinal direction, a first small frame circumferentially enclosing the pair of second mating tongues except on an end side of said pair of second mating tongues in said longitudinal direction, and a first large frame enclosing both the first mating tongue and said pair of second mating tongues except on a longitudinal side of said first mating tongue and said pair of mating tongues; and a second connector mated with said first connector and including:

a second insulative housing a defining a slot essentially in compliance with a third mating interface under condition that the third mating interface matches the first mating interface, and the first mating tongue is electrically and mechanically received in the slot; and a pair of mating plates essentially in compliance with a fourth mating interface under condition that the fourth mating interface matches the second mating interface, and the pair of mating plates are received in the small frame to electrically and mechanically connect the corresponding pair of second mating tongues; wherein the second insulative housing defining a second large frame enclosing both said slot and said pair of mating plates except a portion of a longitudinal side, which is aligned with said pair of mating plates in the transverse direction.

12. The electrical connector assembly as claimed in claim 11, wherein the second insulative housing defines a pair of guiding posts unitarily formed at two opposite end sides of the second large frame in said longitudinal direction, and the first insulative housing defines a pair of guiding slots at two opposite end side of the first large frame in said longitudinal direction to receive the corresponding guiding posts, respectively.

13. The electrical connector assembly as claimed in claim 12, wherein the pair of second mating tongues communicates with the corresponding guiding slot in said longitudinal direction before said second connector is mated with the first connector.

14. The electrical connector assembly as claimed in claim 12, wherein based upon the longitudinal direction, an outer end of an outer one of the mating plates is connected to the corresponding end side of the second large frame.

15. The electrical connector assembly as claimed in claim 11, wherein during mating, a portion of the first small frame is enclosed in the second large frame while remainders are exposed to an exterior.

16. The electrical connector assembly as claimed in claim 11, wherein the second large frame is essentially received in the large first frame except remainders of said longitudinal side of the second frame.

17. The electrical connector assembly as claimed in claim 11, wherein based upon the longitudinal direction, an outer edge of an outer one of the pair of second mating tongues is essentially aligned, in said transverse direction, with an outer edge of the first small frame.

* * * * *